United States Patent [19]

Compen

[11] 4,151,312

[45] Apr. 24, 1979

[54] MAKING A CATHODE RAY TUBE HAVING A CONDUCTIVE COATING ON THE INNER SURFACE WITH A SHARPLY DEFINED SMOOTH EDGE

[75] Inventor: Johannes M. A. A. Compen, Eindhoven, Netherlands

[73] Assignee: U.S. Philips Corporation, New York, N.Y.

[21] Appl. No.: 717,371

[22] Filed: Aug. 24, 1976

[30] Foreign Application Priority Data

Sep. 1, 1975 [NL] Netherlands ..... 7510274

[51] Int. Cl.[2] ..... H01J 29/88; B05D 5/12

[52] U.S. Cl. ..... 427/64; 118/56; 427/105; 427/106; 427/230; 427/273; 427/235; 427/335; 427/352; 427/353; 427/355; 427/372 R; 427/271

[58] Field of Search ..... 427/64, 271, 273, 105, 427/106, 230, 335, 235, 355, 352, 353, 372 R; 118/56; 252/510, 511; 220/2.1 A

[56] References Cited

U.S. PATENT DOCUMENTS

| | | | |
|---|---|---|---|
| 2,692,209 | 10/1954 | Binder | 118/56 |
| 2,695,593 | 11/1954 | Sullami | 118/403 |
| 2,987,415 | 6/1961 | Taggett | 427/64 |
| 3,759,735 | 9/1973 | Pekosh | 427/64 |
| 3,868,264 | 2/1975 | Kellberg | 427/273 |

*Primary Examiner*—John D. Smith

*Attorney, Agent, or Firm*—Algy Tamoshunas

[57] ABSTRACT

In a method of manufacturing a cathode ray tube an electrically conductive coating is provided on an inner surface of the tube. The boundary of said conductive coating in the neck of the tube is sharply defined by wetting the part of the surface of the tube not to be covered with a liquid to remove the conductive material from that part of the surface up to the boundary, and then rinsing the wetted surface to remove any remainder of the conductive material.

17 Claims, 7 Drawing Figures

Figure 1A:
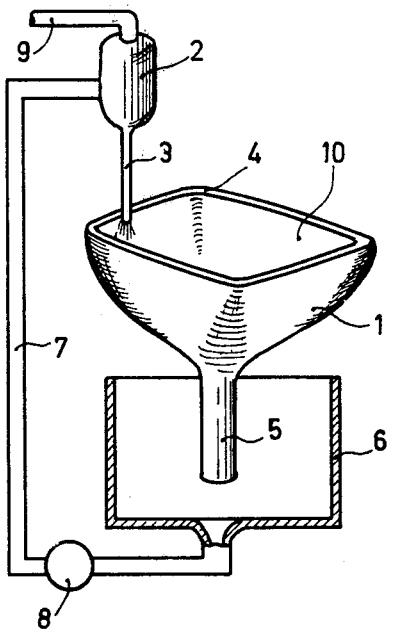

MAKING A CATHODE RAY TUBE HAVING A CONDUCTIVE COATING ON THE INNER SURFACE WITH A SHARPLY DEFINED SMOOTH EDGE

The invention relates to a method of manufacturing a cathode ray tube in which an electrically conductive coating is provided on a part of the inner surface of the tube and has a sharp boundary with respect to the non-covered part of the surface.

The invention furthermore relates to a device for carrying out said method, as well as to a tube obtained according to said method.

Various methods are known for providing an electrically conductive layer on the inner surface of a cathode ray tube, for example a television display tube. Starting from a suspension of electrically conductive particles in a suitable carrier liquid, the conductive layer may be provided by spraying, pouring, dipping or brushing and then be subjected to a thermal hardening treatment so as to obtain a hard layer. In general such a layer is provided on the inner wall of the cone and a part of the neck of the tube. A problem involved is to obtain a readily defined boundary of the conductive layer with respect to the uncovered part of the surface. Conductive particles remaining on what should be the uncovered part of the surface are a drawback, when during operation of the tube the conductive coating has applied to it a potential of a few tens of kilovolts because electric flashovers may occur, between said conductive layer and these unwanted conductive particles.

U.S. Pat. No. 2,695,593 discloses a method of internally coating a cathode ray tube with a conductive suspension, in which the boundary of the layer is obtained by placing a rubber stopper in the neck of the tube. The part of the tube above the stopper is filled through a pipe inserted through an aperture in the stopper with the conductive suspension up to a certain level and is then drained. After drying the conductive coating remaining on the tube wall the stopper is removed from the neck of the tube. However, this method has the drawback that after removing the stopper a thick slightly milled ribbed edge remains. This edge easily crumbles away when in assembling an electron gun in the neck of the tube, the usual centering and contact springs secured to said gun are slid over said edge. Such crumbled-away particles may remain in the tube and cause short circuit between the electrodes. Furthermore, when the conductive coating conveys a high potential, undesired sputtering phenomena may occur at the milled boundary of the conductive coating. Another drawback of the known method is that the conductive suspension also remains on the rubber stopper so that upon removing said stopper the non-covered part of the tube is easily contaminated and has still to be cleaned.

According to the invention, after providing the conductive coating, the desired boundary thereof is obtained by wetting the part of the surface not to be covered with a liquid which removes the conductive material from the place where said boundary should be formed and then cleaning said wetted surface by rinsing. The boundary of the conductive layer has been formed to show a smooth edge which does not crumble away when an electron gun is inserted into the neck of the tube and which does not exhibit inadmissible sputtering phenomena when the conductive layer conveys a high potential. Furthermore, the method suitable for mechanisation.

The composition of the liquid with which the conductive material is removed from the wall of the tube depends upon the composition of the conductive layer. Furthermore, where the layer is deposited from a suspension, the liquid for removing a dried layer will generally have a composition differing from that for removing a layer which has not yet dried. A layer which has not yet dried can usually be removed more simply than a dried layer. In providing the conductive coating it is suitable to start from a suspension of electrically conductive particles in a suitable carrier liquid. At least a part of the surface of the tube is covered with a layer of the said suspension and the part of the surface not to be covered is kept wet from the place where the boundary of the coating should be formed, while the remaining part of the coating is dried and the part of the surface not to be covered is finally rinsed clean. Preferably the removal of the coating and the rinsing of the part of the surface of the tube not to be covered are carried out in one operation.

In another embodiment the part of the surface not to be covered is wiped clean by means of a wiping member at least at the area where the boundary of the conductive coating should be formed. Preferably, the wiping member performs a rotary movement about an axis parallel to the longitudinal axis of the tube with a continuous supply of rinsing liquid.

It is to be noted that the above mentioned United States Patent Specification also starts from a suspension for providing the conductive coating. It is also stated that during drying the suspension, condensation of water vapour occurs on the wall of the neck of the tube so that when the stopper is removed a clean surface would be left. However, the already-mentioned drawbacks remain because the boundary of the conductive coating is determined by the stopper itself while the formed quantity of condensation is insufficient to obtain a clean surface when the stopper is removed.

The method according to the invention can be performed efficaciously with a device which comprises means to support a cathode ray tube and furthermore comprises a nozzle mounted on a liquid duct, said nozzle being movable axially in the neck of the tube and having means for guiding a jet of liquid emerging from the nozzle in a direction which encloses an acute angle with the said axial direction in such manner that, measured in a plane through the axis of the tube, the jet of liquid encloses an obtuse angle with the surface of the neck of the tube to be cleaned. The outflow aperture in the nozzle is preferably rotationally symmetric so that a substantially rotationally symmetric distribution of the quantity of liquid flowing out of the aperture is obtained. Such a distribution can also be obtained when the nozzle is arranged so as to be rotatable about an axis parallel to the above-mentioned axial direction. In a particularly favourable embodiment of the device the nozzle comprises at least one wiper blade the edge of which, with a relative rotation of the nozzle with respect to the neck of the tube, covers the wall of the neck of the tube over a pre-scribed length.

Figure 1B:
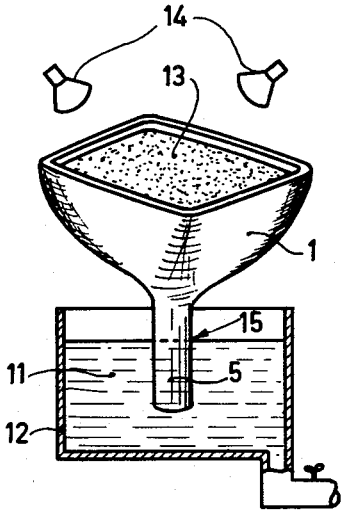
Figure 1C:
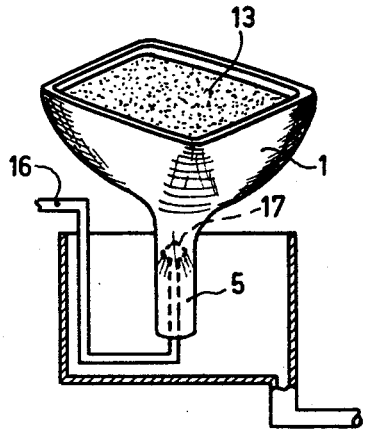
Figure 2:
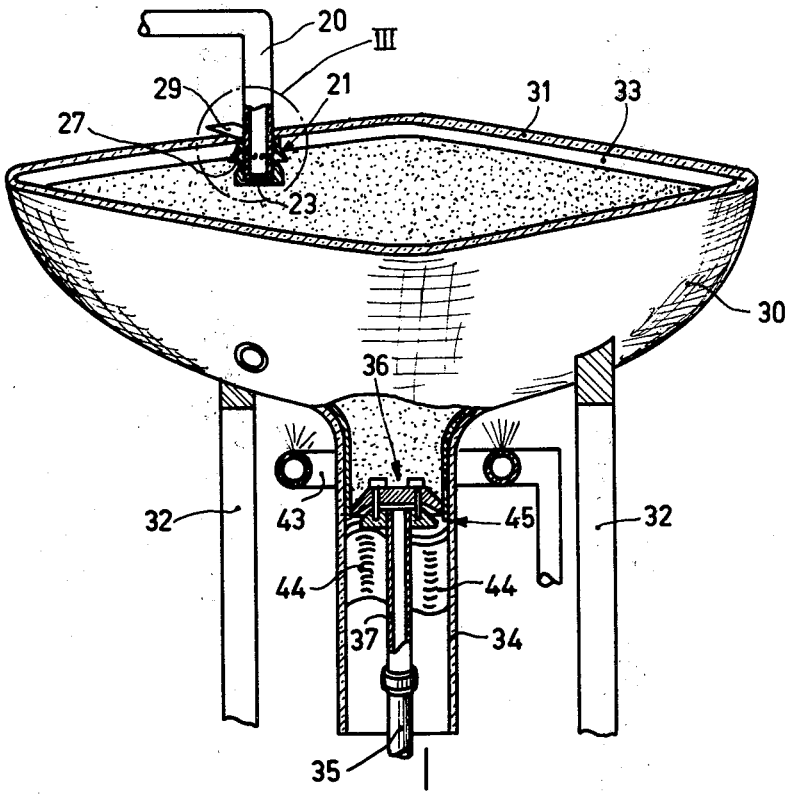
Figure 3:
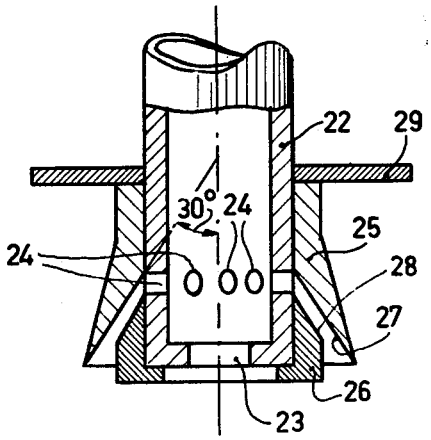
Figure 4:
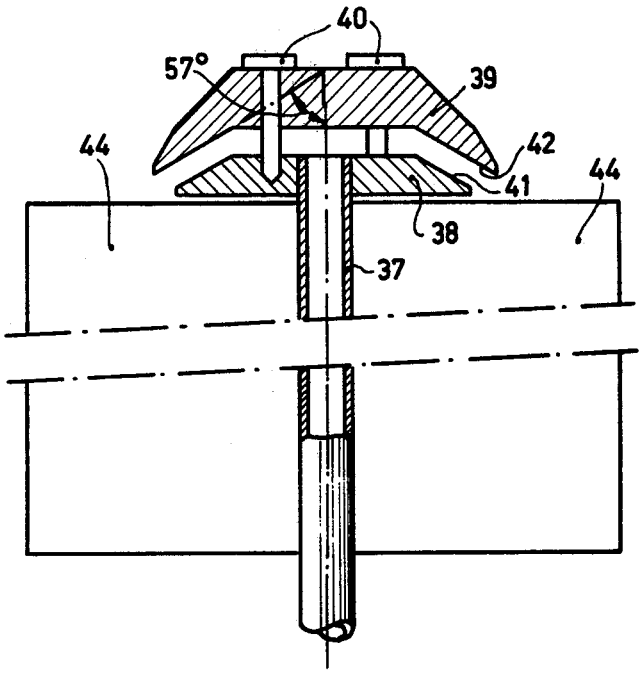
Figure 5:
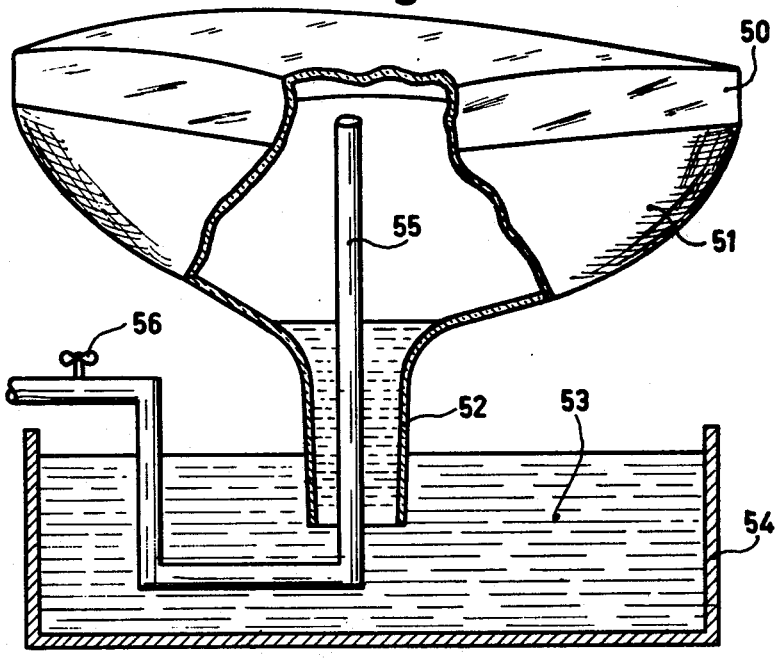

Embodiments of the invention will now be described by way of example with reference to the accompanying diagrammatic drawings in which FIGS. 1*a*, 1*b* and 1*c* show three successive stages of a method embodying the invention, FIG. 2 illustrates another embodiment, FIG. 3 shows a detail of a nozzle for providing a conductive suspension on the inner surface of a cathode ray tube, FIG. 4 shows in detail a nozzle for cleaning the part of the surface of the neck of the tube not to be covered, and FIG. 5 illustrates another method of providing a conductive suspension on the inner surface of a cathode ray tube.

In FIG. 1*a* a glass cone 1 of a tube is coated internally with a conductive material consisting of an aqueous alkali metal silicate solution in which small quantities of an organic binder and a conductive powder are incorporated. Such a suspension comprises, for example, 10–20% by weight of graphite powder as the conductive material, approximately 20% by weight of waterglass consisting of a 20% solution of $K_2O$ and $SiO_2$ in the ratio 1:3.5, approximately 1% of an organic binder, for example polyvinylpyrrolidon and approximately 60% by weight of water. The suspension flows from a container 2 through a pipe 3 which discharges on the inner surface 10 of the cone 1 and hits said surface at approximately 1 cm below the edge 4 of the cone. The pipe 3 is moved along the edge of the cone 1 until the inner surface 10 is covered everywhere with a uniformly thick layer of the suspension. Instead of moving the pipe 3, it is alternatively possible to rotate the cone 1 about its longitudinaly axis, the outflow aperture of the pipe being always kept at a fixed distance from the edge 4 of the cone. The excess suspension flows through the neck 5 of the cone 1 into a reservoir 6 and is pumped by means of a pump 8 back into the container 2 through a return duct 7. The level of the suspension in the container 2 is further maintained through a duct 9. In the phase of the method illustrated in FIG. 1*b* the cone 1 is placed with its neck 5 downwards in a reservoir 12 for example water, filled with liquid 11, so that the liquid level 15 in the neck of the tube is at the place where the boundary of the conductive coating needs to be formed. The wet suspension 13 with the exception of the part which is present below the liquid level 15 is dried by means of a number of infrared lamps 14 or by a flow of warm air. The liquid 11 prevents the suspension from adhering to the immersed part of the neck 5 and the liquid level 15 thus determines the boundary between a dried conductive layer adhering to the wall of the tube and a wet layer not adhering to the wall of the tube. In the subsequent phase illustrated in FIG. 1*c* a nozzle 17 mounted on a liquid duct 16 is inserted axially into the neck 5 of the tube. Deionised water is supplied through the duct 16 and is directed to the wall of the neck 5 by the nozzle 17 so that the non-dried part of the conductive coating of the part of the wall of the tube not to be covered is rinsed. In this manner a readily defined smooth boundary of the conductive coating on the wall of the neck 5 of the tube is obtained.

Several modifications of the method described with reference to FIGS. 1*a*, 1*b* and 1*c* are possible. For example, after providing the conductive suspension, the whole layer may also be dried and then, in analogy with the phase illustrated in FIG. 1*b*, the tube may be placed in a liquid-filled reservoir. In this case it probably will not suffice to use normal water for removing the layer from the part of the tube surface not to be coated, and a more aggressive liquid, for example, dilute HF acid provably, will have to be used.

In another method embodying the invention and illustrated in FIGS. 2 and 3 a conductive suspension of the above-mentioned composition is supplied through a duct 20 as described with reference to FIG. 1*a*. A nozzle 21, of which FIG. 3 is an axial sectional view, is mounted at the open end of the duct 20. The nozzle consists of a pipe 22 which has an axial outflow aperture 23, and also has lateral outflow apertures 24 distributed regularly around its circumference. The outflow direction of the lateral apertures is determined by a collar 25 and a collar 26 having conical surfaces 27 and 28, respectively. Suitably, the conical surfaces make an angle of 30° with the centre line of the pipe 22, the pipe has an internal diameter of 10 mm, the outflow aperture 23 has a diameter of 5 mm and each lateral outflow aperture has a diameter of 1.5 mm and is located at a distance of 10 mm above the aperture 23.

In operation, the nozzle 21 is placed against the inner wall of the cone 30 with the collar 25 being pressed against the wall of the cone and the abutment 29 secured to the nozzle bearing on the edge 31 of the cone. The cone 30 is supported by four supporting members 32 two of which are shown. The supporting members are secured to a base plate not shown in the drawing and are capable of rotating about an axis coinciding with the axis of the tube. During this rotation the suspension is supplied through the duct 20, the edge 31 of the cone being drawn past the nozzle 21. The greater part of the supplied quantity of suspension leaves the nozzle through the aperture 23 while a smaller part leaves the nozzle through the lateral apertures 24. The point of contact of the collar 25 with the wall of the cone determines the boundary 33 of the conductive coating, so that the edge 31 of the cone is not covered with the suspension. In a manner analogous to FIG. 1*a* the excessive suspension can be pumped back through a return duct to a buffer reservoir.

The next phase in the method relates to obtaining a boundary of the conductive coating in the neck 34 of the tube. For that purpose, a nozzle 36 mounted on a liquid duct 35 is inserted axially into the neck 34 of the tube. The nozzle 36 which is shown on an enlarged scale in FIG. 4, consists of a pipe 37 at one end of which is fixed to a circular flange 38 having a diameter of for example 25 mm. A dished second flange 39 is secured to the flange 38 by three bolts 40 spared 120° apart, a space of approximately 2 mm being left between the flanges. Suitably, the flange 3 has a diameter of 27 mm and can be moved in the neck 34 of the tube with a play of 1 mm. The flanges 38 and 3 have conical surfaces 41 and 42, respectively, which enclose an angle of, for example 57° with the centre longitudinal axis of the pipe 37 and determine the outflow direction of the liquid flowing out of the nozzle. With such an arrangement a jet of liquid converging from the nozzle makes an acute angle with the central longitudinal axis of the pipe 37 in such a manner that measured in a plane to which this axis is normal, the jet of liquid makes an obtuse angle with the surface of the neck 34 of the tube. After the nozzle has been inserted in the neck of the tube in the desired place, the coating on the inner wall is dried by spraying warm water, at for example 60° C., against the outer wall of the cone from an annular nozzle 43. If desired, drying may be accelerated by irradiating the inner wall of the cone by means of infrared lamps. Simultaneously with the drying operation, the part of the wall of the neck which is not to be covered is rinsed with a quantity of deionised water of 1 liter per minute supplied through the duct 35. The nozzle 36 rotates at a speed of one revolution per second about its longitudinal centre line and the neck of the tube is wiped clean by means of two rubber wipers 44 secured to the shaft 37. The boundary 45 of the conductive coating is formed at the position where the jet of water flowing out of the nozzle impinges upon the wall of the neck of the tube. In order to prevent a columm of water from forming between the wall of the tube and the flange 39 by capillary action, the flange 39 at its circumference has a thickness of at most 1 mm and preferably less than 0.5 mm. The drawback of such a water column actually is that a poorly adhering coating remains there due to the low water circulation while the adhering constituents are washed out of the suspension.

The two embodiments so far described concern that kind of process in which the cone is provided with a conductive layer before being united with the face place of the tube such methods are suitable for manufacturing a colour television display tube because the faceplate and the cone can be connected together only after providing the internal conductive coating. However, the invention is also applicable when the conductive coating is provided after the faceplate and the cone have been connected together, for example, in the manufacture of a black-and-white display tube and an embodiment using this technique will now be described with reference to FIG. 5.

A glass envelope consisting of a cone 51 sealed to a faceplate 50 is placed in a reservoir 54 with the neck 52 of the tube downwards, the reservoir containing a conductive suspension 53. The air is pumped out of the envelope through a duct 55 causing the level of the suspension in the envelope to rise. When the level reaches the open end of the duct 55 a cock 56 in the duct is closed. The duct 55 is then detached from the pump after which the cock 56 is opened and air is admitted to the envelope and the level of the suspension in the envelope falls to its original height the envelope may then be removed from the reservoir 54. The conductive layer left on the neck of the tube can be removed as required in a manner analogous to that described with reference to FIG. 2.

What is claimed is:

1. A method for coating with an electrically conductive material the inner surface of a cathode ray tube bulb having a funnel portion with a cylindrical neck, said method comprising the steps of supporting the bulb with the neck downward, covering the inner surface of the bulb with a carrier liquid containing said conductive material, allowing said carrier liquid to drain downwardly and leave a residue of said conductive material on said inner surface of said bulb, drying said residue of said conductive material sufficiently to prevent said conductive material on the inner surface of said neck from flowing downwardly, and directing a stream of rinsing liquid along a circumferential line extending about the inner surface of said cylindrical neck, said rinsing liquid being directly outwardly and downwardly at an acute angle to the axis of said neck to strike the inner surface of said neck at an obtuse angle directed away from the coated surface area above said line to rinse away said conductive material from the inner surface of said neck below said line and leave a coating of said conductive material with a sharply defined smooth edge on the inner surface of said neck above said line.

2. The method of claim 1 comprising the step of wiping said internal wall surface of said neck below said line simultaneously with said step of directing said rinsing liquid.

3. The method of claim 1 wherein said rinsing liquid is directed rotationally against said inner surface of said neck to obtain uniform rinising along said line and therebelow.

4. The method of claim 1 wherein said step of drying includes the step of spraying warm water on the external surface of said funnel portion to dry the coating on the internal wall surface thereof.

5. The method of claim 1 wherein said step of drying includes the step of heating the wall surface of said funnel portion with infrared radiation to dry said coating on the internal wall surface thereof.

6. The method of claim 1 in which said rinsing liquid is deionized water.

7. The method of claim 1 comprising immersing the neck end of said funnel portion in liquid up to the location of said line while said drying step is being accomplished; and thereafter carrying out said rinsing step.

8. The method of claim 1 comprising drying the residue of said electrically conductive material above and below said line; thereafter submerging said neck end of said funnel portion up to the location of said line in a reservoir of liquid capable of removing said electrically conductive material up to said location of said line; thereafter removing said neck from said reservoir and carrying out said rinsing step.

9. The method of claim 8 in which the liquid in said reservoir is dilute hydrofluoric acid.

10. A method for applying a band of electrically conductive coating to the inner surface of a cathode ray tube bulb having a funnel portion with an enlarged end and a cylindrical neck, said method comprising the steps of supporting the bulb with the neck downward, covering with a carrier liquid containing a conductive material the inner surface of said bulb up to a first line located near said enlarged end and extending about the inner surface of said funnel portion, allowing said carrier liquid to drain downwardly leaving a coating of said conductive material on said inner surface of said bulb below said first line with a smooth first edge adjacent said enlarged end, drying said coating of said conductive material sufficiently to prevent said conductive material on the inner surface of said neck from flowing downwardly, and directing a stream of rinsing liquid along a second line extending about said inner surface of said cylindrical neck, said rinsing liquid being directed outwardly and downwardly at an acute angle to the axis of the cylindrical neck to strike the inner surface of said neck at an obtuse angle directed away from the coated surface area above said second line to rinse away said conductive material from the inner surface of said neck below said second line and leave behind a coating of said conductive material with a second sharply defined smooth edge on the inner surface of said neck above said second line.

11. The method of claim 10 wherein said enlarged end of said funnel portion is open and comprising the step of directing said carrier liquid outwardy, and downwardly from an origin of said liquid within said open enlarged end to strike said internal sufrace only at and below said first line and allowing said carrier liquid to drain downwardly therefrom to define said first smooth edge.

12. The method of claim 11 comprising the steps of establishing relative movement of said origin of said liquid and said funnel protion to form said first smooth edge entirely around said open end; and maintaining said origin at a substantially fixed distance from said internal surface while said relative movement completes said first smooth edge.

13. The method of claim 12 comprising directing said carrier liquid at said internal surface a substantially fixed distance from the edge of said enlarged end.

14. The method of claim 10 wherein the step of drying includes directing a stream of warm water over the external surface of said funnel portion.

15. The method of claim 14 wherein the step of drying includes directing infrared radiation at the inner surface of said funnel portion simultaneously with directing said stream of warm water at said external surface.

16. The method according to claim 10 wherein the enlarged end of the funnel portion is covered by a faceplate sealed airtight to said enlarged end, the step of covering with said carrier liquid includes immersing the end of said neck in a quantity of said carrier liquid containing the conductive material, removing air from said funnel portion to draw said carrier liquid with the conductive material in said funnel portion up to the location of said first line; and said step of allowing said liquid to drain includes readmitting air to said funnel portion to allow the carrier liquid and the conductive material to flow out of said funnel portion while leaving a residue of said conductive material on said internal wall surface from said first line downward into said neck and removing said bulb structure from said quantity of carrier liquid .

17. A method for coating with an electrically conductive material the inner surface of a cathode ray tube bulb having a funnel portion with a cylindrical neck, said method comprising the steps of supporting the bulb with the neck downward, covering the inner surface of the bulb with a carrier liquid containing said conductive material, allowing said carrier liquid to drain downwardly and leave a residue of said conductive material on said inner surface of said bulb, drying said residue of said conductive material sufficiently to prevent said conductive material on the inner surface of said neck from flowing downwardly, directing a stream of rinsing liquid along a circumferential line extending about said inner surface of said cylindrical neck, said rinsing liquid being directed outwardly and downwardly at an acute angle to the axis of the cylindrical neck to strike the inner surface of said neck at an obtuse angle directed away from the coated surface area above said line to rinse away said conductive material from the inner surface of said neck below said line and leave a coating of said conductive material with a sharply defined smooth edge on the inner surface of said neck above said line, and wiping the inner surface of said neck below said line simultaneously with said step of directing said rinsing liquid.

* * * * *